US007895952B2

(12) United States Patent
Theinert

(10) Patent No.: US 7,895,952 B2
(45) Date of Patent: Mar. 1, 2011

(54) SAND STAND

(76) Inventor: Russell Theinert, San Diego, CA (US)

( * ) Notice: Subject to any disclaimer, the term of this patent is extended or adjusted under 35 U.S.C. 154(b) by 0 days.

(21) Appl. No.: 10/906,072

(22) Filed: Feb. 2, 2005

(65) Prior Publication Data

US 2006/0169186 A1 Aug. 3, 2006

(51) Int. Cl.
*A47B 85/00* (2006.01)

(52) U.S. Cl. ..... 108/27; 108/150; 108/50.11; 108/92

(58) Field of Classification Search ..... 108/150, 108/25, 90, 50.12; 248/533, 532, 530; 135/98, 135/99, 96
See application file for complete search history.

(56) References Cited

U.S. PATENT DOCUMENTS 1,733,001 A * 10/1929 Binger ..... 108/92
2,520,450 A * 8/1950 Austin, Jr. ..... 108/150
2,877,828 A * 3/1959 Barnette, Jr. ..... 248/533
5,161,561 A * 11/1992 Jamieson ..... 248/530
5,263,423 A * 11/1993 Anderson ..... 108/43
5,607,091 A * 3/1997 Musacchia ..... 108/43
D388,974 S * 1/1998 Piker ..... D6/417
5,778,802 A * 7/1998 Hairston et al. ..... 108/90
6,364,183 B1 * 4/2002 Barnard ..... 108/43
6,487,977 B1 * 12/2002 Williams et al. ..... 108/150
6,508,183 B2 * 1/2003 Kerrigan ..... 108/90

* cited by examiner

*Primary Examiner*—José V Chen
(74) *Attorney, Agent, or Firm*—Michael P. Eddy

(57) ABSTRACT

A portable table apparatus with an upper table top, a centrally located post opening, a lower table top including a centrally located post opening and being positioned below the upper table top, a pole having a distal end for penetrating a substrate and an opposite end for passing through the centrally located pole opening in the upper table top and the centrally located pole opening in the lower table top, and a curtain removably positioned around the outer edge of the upper table top.

7 Claims, 5 Drawing Sheets

SAND STAND

DETAILED DESCRIPTION OF THE EMBODIMENTS

Embodiments of the claimed subject matter are generally illustrated in FIGS. 1-5.

Figure 1:
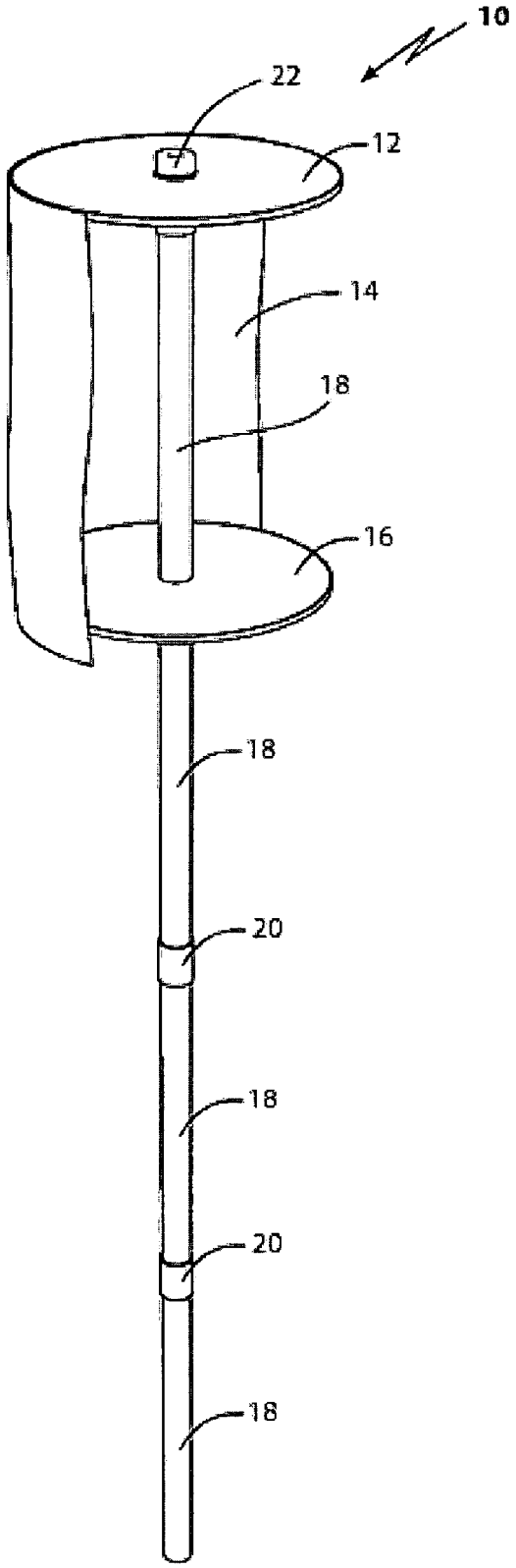
FIG. 1 illustrates a perspective view of an embodiment of the claimed subject matter fully assembled and positioned as to be ready to be placed in the substrate.
Figure 2:
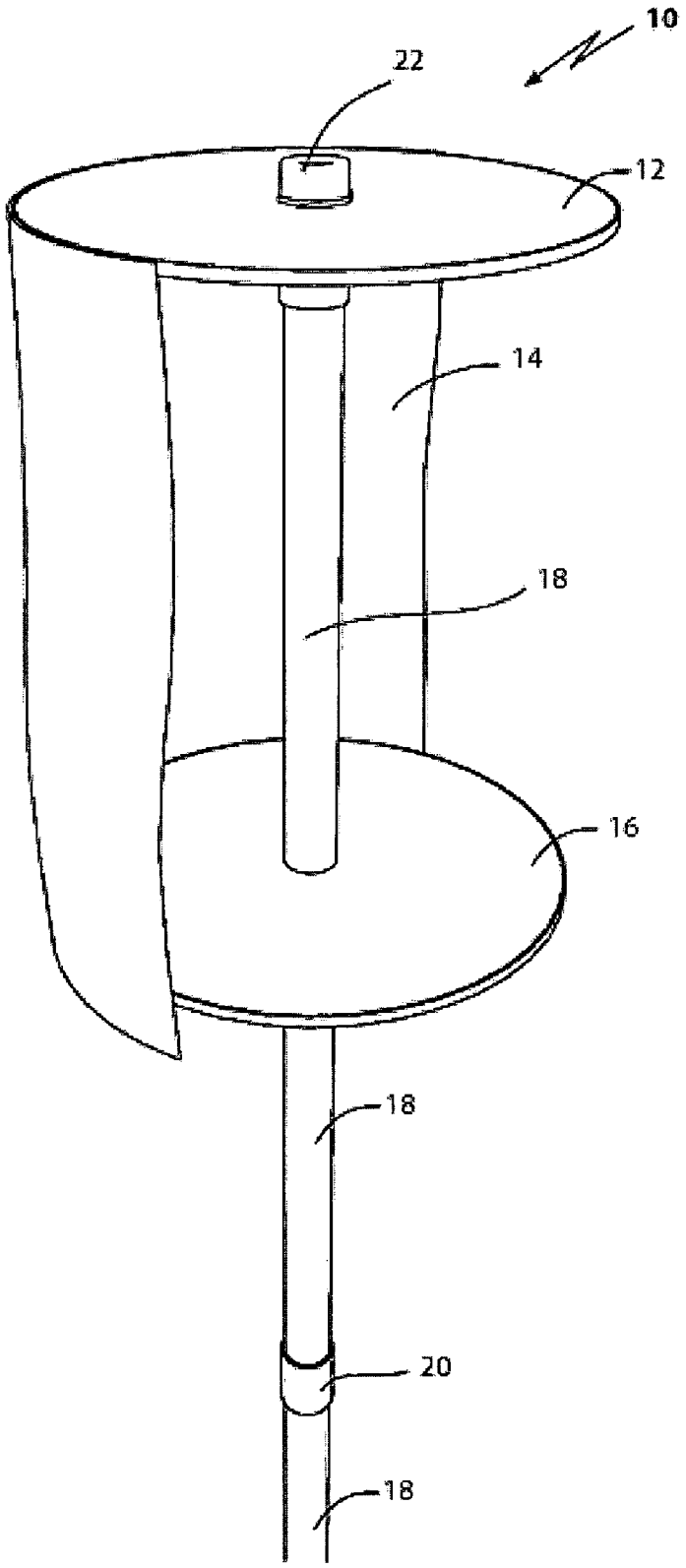
FIG. 2 illustrates a close up perspective view of the top portion of an embodiment of the claimed subject matter.
Figure 3:
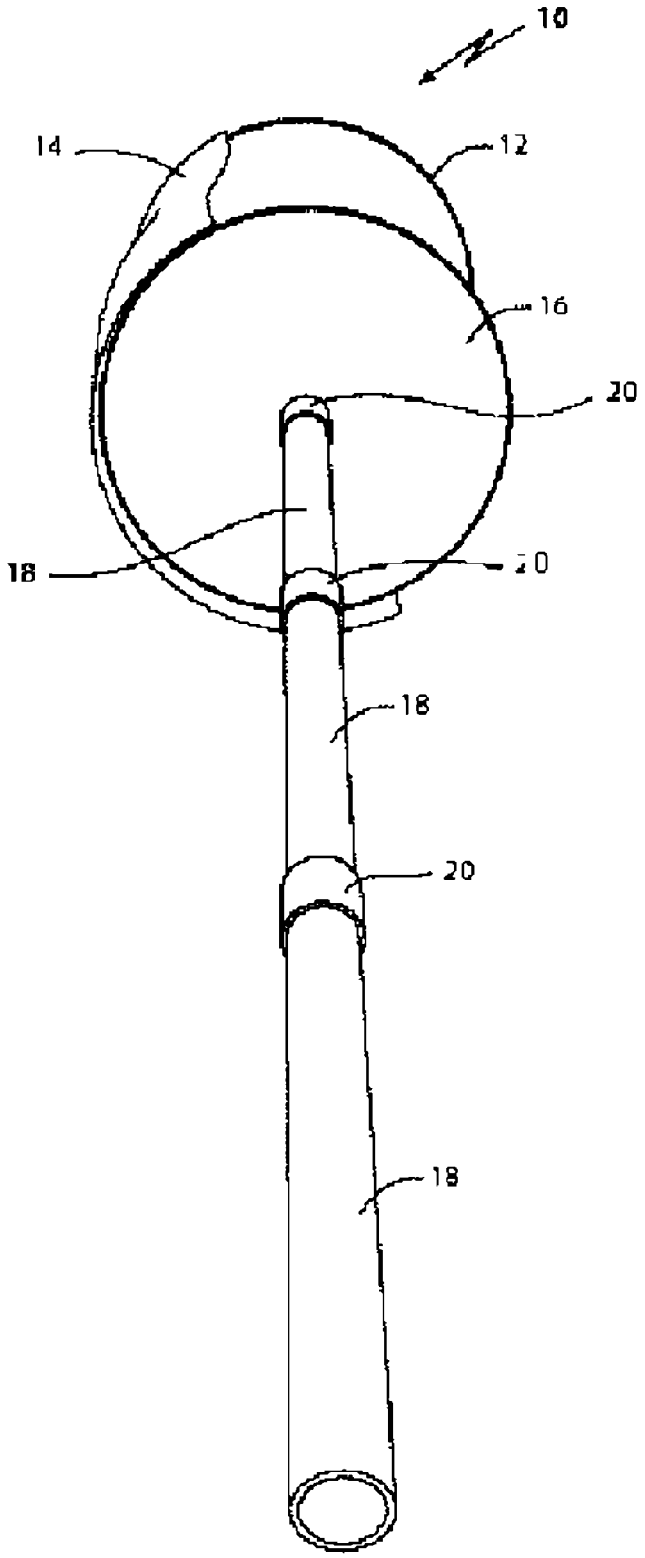
FIG. 3 illustrates an underside perspective view of an embodiment of the claimed subject matter.

FIG. 1 illustrates an embodiment of portable table apparatus 10 that is fully assembled having an upper table top 12 that includes a centrally located post opening (shown with pipe section 18 passing through the opening) and a lower table top 16 including a centrally located post opening. The lower table top 16 is shown positioned below the upper table top 12, a post made up of pipe sections 18 and sleeve connectors 20 having a distal end for penetrating a substrate and an opposite end for passing through the centrally located pole opening in said upper table top and in said lower table top, and a curtain 14 removably positioned around the outer edge of said upper table top 12. Cap 22 is also shown attached to the end of pipe section 18 at upper table top 12.

Upper table top 12 and lower table top 16 can be formed from wood, paper, rubber, metal, Plexiglas, Lexan, molded plastic or any other suitable material. Upper and lower table tops may also be equal in diameter and thickness or different. Upper table top 12 and lower table top 16 each have an edge. In various embodiments, the thickness of the table tops can vary from 1/16" to 3 inches. Upper table top 12 and lower table top 16 may also be interchangeable. As illustrated in FIGS. 1, 2, 3, 4 and 5, upper table top 12 and lower table top 16 are round, but they can be any size or shape. In various embodiments, the shapes of either or both tables can also be octagon, oval, square, rectangle, triangle, pentagon or hexagon shapes.

Other embodiments include upper and lower table tops with a surrounding rigid strip (not shown) which may be formed from metal, plastic or other durable materials.

Hook and/or loop may be then affixed to this rigid strip. This reinforced edge may be made up of one ore more hard, rigid strips positioned along a portion of the edge. The strips have a hook or loop material applied to the exterior of the strip or strips so as to complement the hook or loop found on the inside of curtain 14. A nylon mesh pocket (not shown) may also be affixed to the underside of lower table top 16 providing additional space for storage. Hook and loop may also be applied to the edge of lower table top 16.

Lower table top 16 may include a lip around the edge that raises the edge of lower table top 16, for instance to maintain soft drink cans in an upright position when portable table apparatus 10 is accidentally bumped or jarred during periods of wind gusts. Elastic straps, attached through or to the surface or any other area of lower table top 16 or upper table top 12 may also be used to hold items in place. Upper table top 12 may also include a similar lip around the edge of upper table top 12 and it may have elastic straps to hold items to the surface of upper table top 12.

The portable, collapsible table apparatus 10 may also have more than one lower table tops 16 instead of a single lower table top 16.

As shown in FIGS. 1, 2, 3, 4 and 5, the post used as a support stand for table apparatus 10 consists of multiple sections of pipe segment 18 which may be formed with terminal beveled distal end at the lowermost segment 18 to allow penetration into sand or soil with ease. Pipe section 18 can be slidably withdrawn from upper table top 12 and lower table top 16, after which table top 12 can be lifted from uppermost pipe segment 18.

Upper table top 12 is positioned so that a first pipe section 18 extends through and below the center of upper table top 12. Cap 22 is placed on the end of pipe section 18 which extends from the central opening on upper table top 12.

When used in multiples, pipe sections 18 can be of the same or different lengths, to define a single post. A single pipe section 18 can also be used as the post. For example, several PVC pipe lengths assembled in one or more units can form the post. Pipe segments 18 may have an outer diameter of approximately two to three inches and is sized to snugly fit within connectors 20. Other embodiments of pipe section 18 can have varying diameters from ¼ inch to 6 inches. Cap 22 can be secured to the end of uppermost section 18 using threading on the cap and on the section 18, or it can be secured with friction forming a snug fit.

Figure 5:
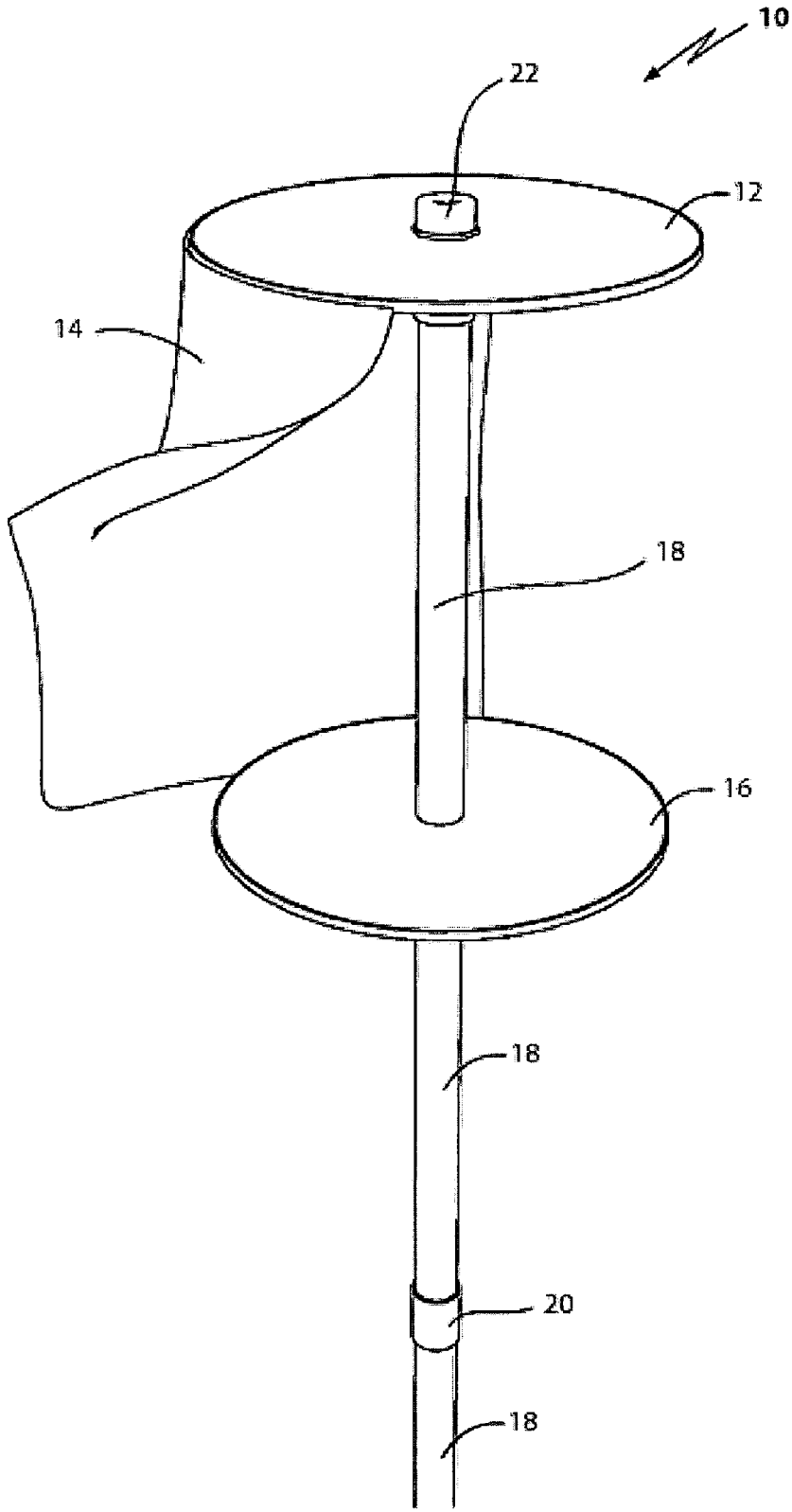
FIG. 5 illustrates a perspective view of an embodiment of the claimed subject matter with the curtain pulled back.

Pipe sections 18 can be secured together with connector sleeves 20 that may be integral to the pipe lengths or attached by the end user before use. In one embodiment, connectors 20 are positioned over the ends of the pipe sections 18 and pressed together. In this embodiment, no other components are needed to combine multiple pipe sections 18 into a post. As shown in FIG. 1, four pipe sections 18 can be mated with three sleeves 20 to form a post. By removing or adding one or more pipe sections 18 and/or by varying the length of each pipe section 18, the height of apparatus 10 can be adjusted. In another embodiment, the pipe sections may also be joined at the ends using complementary male and female threaded ends. As shown in FIG. 5, the uppermost pipe segment 18 passes through the center of the upper table top 12 and the center of the lower table top 16. Also shown in FIG. 5 is the uppermost segment 18 connected to the lowermost pipe segment 18 utilizing connector 20.

Curtains 14 are illustrated in FIGS. 1, 2, 3 and 5 as affixed to the exterior edge of upper table top 12 so as to hang down below the edge of lower table top 16. Hook and loop material such as Velcro® may be used to attach an edge of curtain 14 to the outer edge of upper table top 12. Curtain 14 has a hook or loop strip sewn into the interior top edge of curtain 14 so as to abut the edge of lower table top 16 and curtain 14 may also have an additional length of hook and/or loop material sewn into a lower section of curtain 14 so as to complement and abut a hook and/or loop strip on the edge of lower table 16. Curtain 14 may also be attached to upper table 12 and/or lower table 16 with other materials or manners such as a clip placed on the side, upper surface or lower surface of upper table top 12.

Curtain 14 can be made of fabric, cloth, plastic, metal, rubber, latex or other similar material and the apparatus could come in different colors, lengths and shapes. The length may be long enough to cover more than one lower tables 16, such up to 72 inches long in some embodiments. It may also be very short, such as 1" long for other embodiments. It can also be from 1 to 72 inches wide so that it does not wrap around table tops completely or so that it wraps around the table tops several times. The shape of curtain 14 may be square, rectangular, triangular or other shape. Curtain 14 provides protection against wind blowing over drinks or items placed on lower table 16. These items, for example drinks or personal electronic equipment, can thus be protected from elements such as sand and sun.

Figure 4:
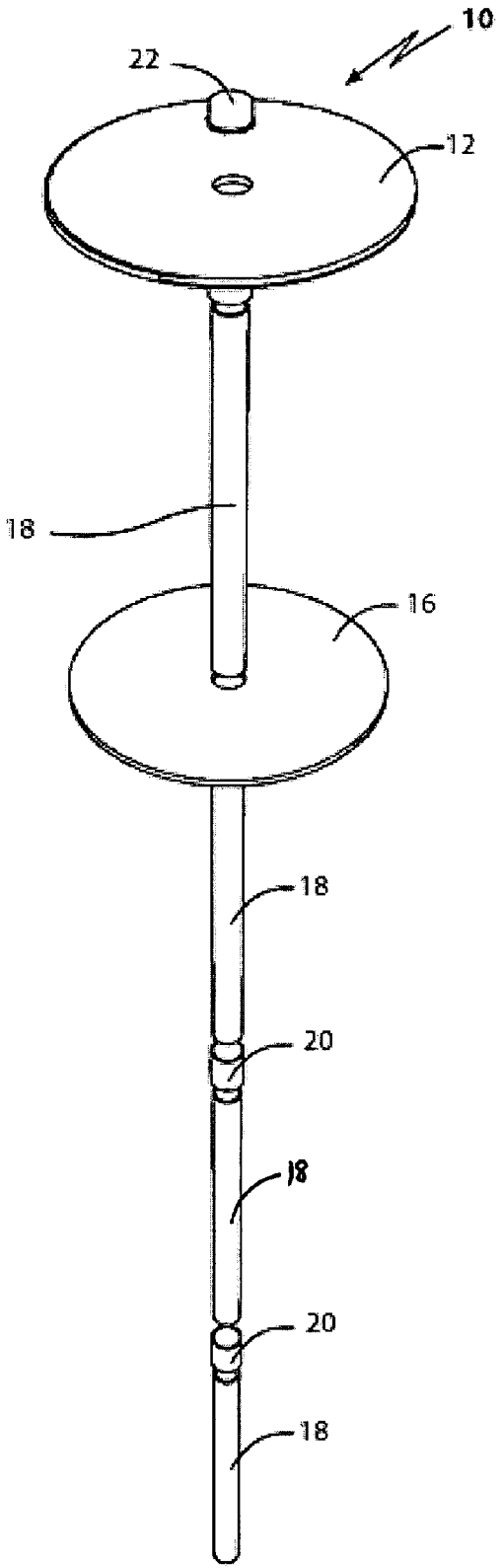
FIG. 4 illustrates a component view of an embodiment of the claimed subject matter.

FIG. 4 illustrates a component view of an embodiment of portable table apparatus 10. Apparatus 10 is easy to assemble, easy to transport, and light to carry. When disassembled, portable table apparatus 10 can be compactly stored and transported in a nylon or fabric bag. FIG. 5 also illustrates curtain 14 partially drawn away from lower table top 16. It can be used for the beach, parks, backyards, picnics and many other places.

Portable table apparatus 10 may be adjusted to varying heights for different users or uses by changing the number of pipe sections and/or the length of each pipe section. Table apparatus 10 may be constructed at the factory to a predetermined height or it may be height adjustable by the end user by using combinations of shorter and longer pipe sections 18. Embodiments of portable table apparatus 10 are light in weight and able to be carried and set up by an individual on a beach or the like in a few minutes. Once in place, table apparatus 10 should remain stationary even in strong winds and it can be used to protect valuables against the elements while the user is engaged in other activities. Portable table apparatus 10 can be used to provide a personal storage surface for items at arms length. Portable table apparatus 10 can also be broken down into its components and stored easily when not in use, and when assembled, used to support drinks or food when one sits in an area with soft substrate such as the sand on a beach or grass at a park. After use, by simply reversing the assembly steps table apparatus 10 can be quickly disassembled and manually carried off until the next use.

The illustrations and examples provided herein are for explanatory purposes and are not intended to limit the scope of the appended claims.

What is claimed is:

1. A portable, collapsible table apparatus comprising:

an upper table top and a lower table top positioned below said upper table top, wherein said upper table top and said lower table top define a protected space therebetween, each of said upper table top and said lower table top including a centrally located post opening;

a post having a distal end for penetrating a substrate and an opposite end for passing through the centrally located pole opening in said upper table top and in said lower table top; and a curtain for protecting said protected space, the curtain being detachably attached to the outer edge of said upper table top and to the outer edge of said lower table top.

2. The portable, collapsible table apparatus of claim 1, wherein said pole is made up of two or more sections of pipe securely held in place by sleeves.

3. The portable, collapsible table apparatus of claim 1, wherein said pole is made up of two or more sections of threaded pipe attached by said threads.

4. The portable, collapsible table apparatus of claim 1, wherein said curtain is removably positioned around the outer edge of said upper table top with hook and loop material.

5. The portable, collapsible table apparatus of claim 1, wherein said curtain is removably positioned around the outer edge of said upper table top and the outer edge of said lower table top with hook and loop material.

6. The portable, collapsible table apparatus of claim 1, wherein said post is made up of multiple removable pipe sections.

7. The portable, collapsible table apparatus of claim 6, wherein said pipe sections are constructed from a material selected from the group consisting of plastic, wood, paper, rubber, metal, Plexiglas, and Lexan.

* * * * *